United States Patent [19]

Pittman et al.

[11] 4,056,354

[45] Nov. 1, 1977

[54] PROCESS FOR RAPID DYEING OF TEXTILES

[75] Inventors: Allen G. Pittman, El Cerrito; William L. Wasley, Pacific Grove, both of Calif.; Nelson F. Getchell, Great Falls, Va.

[73] Assignee: The United States of America as represented by the Secretary of Agriculture, Washington, D.C.

[21] Appl. No.: 657,011

[22] Filed: Feb. 10, 1976

[51] Int. Cl.[2] ..... C09B 67/00; D06M 3/02; D06M 5/14; D06M 1/00

[52] U.S. Cl. ..... 8/54; 8/93; 8/127.51; 8/128 R; 8/129; 8/53; 8/54.2; 8/162 R; 8/115.5; 8/116 R; 8/127.5; 8/15

[58] Field of Search ..... 8/93, 54, 128 R

[56] References Cited

U.S. PATENT DOCUMENTS

| | | | |
|---|---|---|---|
| 3,112,983 | 12/1963 | Collins | 8/93 |
| 3,623,832 | 11/1971 | van Assche et al. | 8/54 |
| 3,932,125 | 1/1976 | Wasley et al. | 8/128 R |

OTHER PUBLICATIONS

Sisley, M. J. P., Rev. Gen. Mat. Col., vol. 39, (1935).

Bird, C. L., The Theory and Practice of Wool Dyeing, Denn House, Pickadilly, (1963), pp. 63–65.

*Primary Examiner*—Harry Wong, Jr.

*Assistant Examiner*—Maria S. Tungol

*Attorney, Agent, or Firm*—M. Howard Silverstein; David G. McConnell; Theodore J. Leitereg

[57] ABSTRACT

Textile fibers are dyed in a dyebath containing the dye and ethylene glycol as the solvent. Generally, the dyeing is conducted at a temperature of about from 110° to 165° C. until the desired level of dyeing is attained. Excellent results are obtained in a very short time period, e.g., from about 2 seconds to 10 minutes.

15 Claims, No Drawings

PROCESS FOR RAPID DYEING OF TEXTILES

DESCRIPTION OF THE INVENTION

The invention relates to and has among its objects the provision of novel procedures for rapidly dyeing textiles. Further objects of the invention will be evident from the following description wherein parts and percentages are by weight unless otherwise specified.

It is well-known that many textiles must be dyed either prior to or after formation into utilizable products. For centuries the dyeing of textiles has been carried out in aqueous solutions. Presently, textiles are dyed commercially by agitating the textile in an aqueous dyebath maintained at boiling temperatures for a period of one hour or longer. The dyeing operations require large quantities of water, usually about 10–50 times the weight of the fabric being treated. The disposal of the resulting spent liquors has created a major pollution problem. Adverse legislation and public opinion are forcing the industry to adequately treat spent dyeing liquors before they are discharged into public waterways. Such activities, in turn, are leading to increased costs for the industry and, ultimately, for the consumer.

Attempts have been made at replacing water with an organic solvent, such as perchloroethylene, which can be recovered easily by distillation. There are, however, several disadvantages inherent in solvent dyeing. First of all, such solvents are not capable of dissolving polar or ionic dyes conventionally used in aqueous systems and adapted for use with particular fibers. For example, acid dyes conventionally used in wool dyeing are not soluble in such organic solvents. Accordingly, the use of solvent dyeing systems will necessitate the development of appropriate solvent-soluble, non-polar dyes. Since dyes derive much of their affinity for fibers from their polarity, the creation of suitable non-polar dyes becomes even more difficult. Secondly, distillation procedures required for recovery of solvent from spent liquors are expensive and invariably involve a loss of material, usually to the atmosphere, thus causing an atmospheric pollution problem.

The dyeing of polyester fibers or fabrics in water requires the use of a carrier to facilitate the reaction of the fiber with the dye. Generally, for this purpose an arylphenol, such as o-phenylphenol, is employed. If the dyeing is carried out at atmospheric pressure, a substantial amount of the carrier, e.g. about 10% or more based on the weight of the fiber, is necessary. The dyeing of the polyester may be carried out at superatmospheric pressure, under which circumstance less carrier is required. However, the use of high pressures is expensive. Furthermore, the carriers present a substantial pollution problem and disposal of the spent dyeing solutions is difficult and expensive. It should be noted also that the dyeing of polyester fabric requires about the same amount of time as aqueous dyeing of natural fibers, i.e., about one hour or longer.

The invention described herein provides a means for obviating the problems outlined above. In accordance with the invention, fibers are dyed in a bath in which the dye is dissolved in ethylene glycol. The primary advantage of the invention is that dyeing can be accomplished in a very short time. As a result of the process of the invention the dyeing time can be reduced from one hour or more to as little as 2 to 10 seconds. Thus, the present invention is extremely useful, efficient, and economical. Rapid, continuous processing is much less costly than slow, continuous processing or slow, batch processing.

It should be noted that the rapid dyeing feature of the invention is totally unexpected. In the instance where other organic solvents have been substituted for water, the time of dyeing did not vary from that in conventional aqueous dyeing (i.e., one hour or longer). Furthermore, some organic solvents required even longer dyeing periods.

Another advantage of the invention is that ethylene glycol, as opposed to other organic solvents, such as hydrocarbon and chlorinated solvents, swells the textile fibers and permits the dye to penetrate. Thus, the dye is applied to the fabric evenly as well as swiftly.

A further advantage of the invention is that ethylene glycol readily dissolves dyes which are conventionally used on textiles. Other organic solvents, particularly hydrocarbon and chlorinated solvents, dissolve very few dyes unless the dyes are chemically modified to render them soluble.

Another advantage of the invention is that polyesters can be dyed without the use of carriers and high pressures. Thus, the invention is much more economical than known procedures for dyeing polyesters. In addition, pollution of the environment with the carrier is avoided. It should be noted further that the dyeing of polyester fibers takes place with the same rapidity as that of other fibers, i.e., the dyeing time can be reduced from 1 hour or longer to as little as 2 to 10 seconds.

Another advantage of the invention is that the textile fabrics may be dyed without impairing the desirable properties of the textile. That is to say, such properties as hand, elasticity, porosity, resilience, strength, wear-resistance, etc., are not harmed.

Another advantage of the invention is that the dyed fabric retains its color even after repeated launderings. In conventional dyeing, prolonged boiling or other severe conditions must be used to obtain washing fastness. Under such conditions the fiber is readily susceptible to damage. The instant invention avoids these severe conditions.

A further advantage of the invention is that the dyebath can be reused after regeneration with additional dye. In addition, most of the ethylene glycol solvent can be recovered, if desired, according to standard procedures, and reused in preparing other dyebaths. Any residual solvent containing spent dyes and the like can be disposed of readily without danger to the environment.

Another advantage of the invention is that it may be practiced, with only slight modification, using conventional dyeing equipment to be found in any textile-treating plant. Thus, purchase of new machines, etc., is avoided.

A further advantage is that the invention has extensive utility and can be applied to textiles which consist entirely of protein fibers (e.g., wool, mohair, silk, camel or other animal hair; regenerated protein fibers such as those prepared from casein, soybeans, peanut protein, zein, gluten, egg albumin, collagen, or keratins such as feathers, animal hoof or horn, etc.). The invention can also be applied to textiles which contain synthetic or non-proteinaceous natural fibers, such as cotton, linen, hemp, jute, ramie, sisal, cellulose acetate, cellulose acetatebutyrate, saponified acetate rayons, viscose rayons, cuprammonium rayons, ethyl cellulose, polyurethane, polyacrylonitrile, polyesters such as polyethylene terephthalate, polyamides such as polyhexamethylene adipamide, polycaprolactam, polyolefins such as polypropylene and polyvinylchloride, and the like. It is also within the purview of the invention to use mixtures of proteinaceous and other fibers, such as synthetic and non-proteinaceous fibers.

The textile material to which the invention is applied may be in the form of bulk fibers, yarns, silver, roving, top, webbing, tape, or woven or knitted fabrics, garments, garment parts, or non-woven fiber assemblies, e.g, felt.

A most important advantage and feature of the invention is that other chemical treatment, i.e., the application of finishing agents, of the textile may be carried out concomitantly with the dyeing operation. The following finishing agents may be used in this particular embodiment of the invention, by way of illustration and not limitation: shrinkproofing agents, shrink-resist agents, flameproofing agents, flame-resist agents, mothproofing agents, soil-resist agents, soil-release agents, waterproofing agents, oil-repellants, anti-static agents, softening agents, odorants, durable press agents, wrinkle-resist agents, etc. It is further to be noted that such treatment also are accomplished much more rapidly in ethylene glycol than in conventional solvents. In addition, application of finishing agents may be carried out in ethylene glycol in the absence of any dye. Indeed, this procedure also offers the unexpected advantages of rapid treatment, durability, etc.

Another advantage of the invention is that two different fibers can be dyed simultaneously, i.e., cross-dyed, in the same dyebath. In this particular embodiment of the invention, the two fibers must differ in their reactivity toward the dyes employed; each being reactive to only one of the dyes. In that event, rapid, complete dyeing of each fiber can be obtained in the same dyebath. Further, the dyed fibers retain their color intensity even after repeated aqueous launderings.

DETAILED DESCRIPTION OF THE INVENTION

In dyeing in accordance with the invention one proceeds in part as in conventional dyeing operations with certain exceptions resulting from the fact that ethylene glycol is employed as the dyebath solvent. As explained earlier, the time of dyeing is much less than in conventional procedures. In addition, a different temperature of the dyebath is employed. However, the particular dye and adjuvants and the amounts thereof are selected in accordance with the usual principles of dyeing and thus may be varied over a wide range.

The most important departure from conventional practice is that the process of the invention is preferably conducted continuously rather than batchwise. This is so because of the very short period of time required to achieve good dyeing of the textile fabric. As a consequence, only minimal contact between the fabric and the dyebath is necessary and, consequently, much more fabric can be processed in a shorter period of time than in conventional methods. Thus, continuous processing is most feasible.

In a preferred embodiment of the invention the following steps are applied:

I. A dyebath is prepared by dissolving the appropriate type and amount of dye in ethylene glycol. If any dyeing adjuvants such as sodium sulphate, sodium chloride, sulphuric acid, phosphoric acid, wetting agents, etc., are used, they are incorporated into the solution at this time. Furthermore, any finishing agents should be added to the dyebath accordingly. Where it is desired only to apply a finishing agent and not to dye, the dyes are not employed; only the appropriate chemical reagent is added to the ethylene glycol, along with any needed or desired adjuvants such as acids or wetting agents and the like.

The total amount of the dyebath will generally be about 10 to 500 parts of ethylene glycol per part of fibrous material. In any event, the amount of solvent must be sufficient to wet out the fiber. The amount of dye will vary with such factors as the nature of the dye, the fiber, and the level of dyeing desired. In many cases, one uses about 0.01 to 5% of active dye, on a weight-/volume basis. For example, for light dyeing about 0.01 to 0.05% is used; for medium dyeing, about 0.05 to 0.1%; for heavy dyeing, about 0.1 to 1.0% or more. In any case, enough dye should be employed to obtain a 0.1 to 10% uptake thereof by the fiber (based on the weight of fiber). The dye employed is obviously selected according to color desired and ability to dye the fibers under treatment.

II. Having established the proper dyebath, the temperature thereof is raised to between 110° to 165° C. and maintained thereat during the dyeing. The textile material to be dyed is then immersed in the dyebath. As in conventional dyeing, it is necessary to maintain intimate contact between the fibers and the dyeing solution. The contact of the fibrous material with the hot dyebath is maintained for a period of long enough to attain the desired level of coloration. Unlike conventional dyeing, this will be about from 2 seconds to 10 minutes. A shorter time is required the higher the temperature of the dyebath. The amount and type of dye used also depends on the type of textile to be dyed.

Because of the short time required to achieve good dyeing, the process of the invention may be carried out continuously. Accordingly, the textile fiber or fabric is passed through the dyeing solution for a period of time coinciding with that required to achieve the desired coloration. To this end, the fiber, such as top, or fabric may be attached to two rollers, one of which is driven, to pull the fiber or fabric through the dyebath. Other means of carrying out the process of the invention in a continuous manner, such as on a screen, or belt, or perforated drum, will be obvious to those skilled in the art. It should be noted that the concentration of dye in the dyebath must be obtained at an appropriate level. Thus, additional dye must be added to the dyeing solution at various times during the course of continuous operation.

Some textiles require more intimate contact with the dyeing solution than other textiles. To obtains such contact, the dyebath may be stirred, rocked, tumbled, and the like, or the fibrous material may be moved about in the bath. Preferably, it is desirable, under such circumstances, to circulate the bath through the mass of fibrous material. For example, high-pressure jets of dyebath solution can be applied to one side of the immersed fabric. The pressure forces the dyeing solution through the textile so that complete and even dyeing may take place. Other methods of securing the appropriate degree of contact will be obvious to those skilled in the art.

III. After completion of the dyeing, the fabric is removed from the dyebath and treated to remove excess liquid therefrom. To this end, the fabric can be passed through squeeze-rollers or the like. The excess dyeing solution so removed can be recycled or treated to recover ethylene glycol. The textile is then dried in conventional manner.

In an alternate method, the fabric may be passed through squeeze-rollers and then extracted with an organic solvent, such as methanol, to remove excess ethylene glycol and unreacted dye. Following the extraction procedure, the fabric is then dried in a conventional manner. The extracted liquor can be distilled to separate the methanol from the dyeing solution, which can be recycled.

In the alternative, the textile may be rinsed with water, either before or after passing it through squeeze-rollers, to remove residual dyeing solution. The wet fabric is squeezed to remove excess water and dried. This method is less preferred in large-scale operations because recovery of the ethylene glycol, etc., from the aqueous medium is expensive and difficult.

Hereinabove, the use of ethylene glycol as the dyebath solvent has been emphasized. It should be noted that this is by way of illustration and not limitation. In its broad ambit, the invention encompasses the use of glycidol, propylene glycol, glycerol, or diethylene glycol, as a solvent.

EXAMPLES

The invention is further demonstrated by the following examples supplied by way of illustration and not limitation.

The proportion of various ingredients is expressed as the percentage based on the weight of ingredient to the volume of ethylene glycol, this being abbreviated as "*w/v*."

Some samples were subjected to aqueous laundering in a reversing, agitator-type, household washing machine, using a 3-lb. load, a water temperature of 105° F., and a low-sudsing detergent in a concentration of 0.1 percent in the wash liquor. The wash cycle itself was for 15 minutes, followed by the usual rinses and spin-drying. In most cases this washing program was repeated. The damp material was then tumble-dried in a household-type clothes dryer.

EXAMPLE 1

Dyeing of Loose Wool Fibers

A dyebath was prepared containing 0.2% (w/v) Fast Light Red (Colour Index Acid Red 37) and 0.6% (w/v) phosphoric acid in 10 ml. of ethylene glycol. The temperature of the bath was raised to and maintained at 150° C. A sample of loose, clean wool fibers (1 g.) was immersed in the dye solution for 30 seconds, removed therefrom, and rinsed immediately with water. The sample was then dried.

The above experiment was repeated with the following dyes:

| Commercial Dye | Colour Index Designation | Chemical Type |
|---|---|---|
| Alizarine Direct Blue | C I Acid Blue 41 | Anthraquinone |
| Alizarine Sky Blue | C I Acid Blue 232 | " |
| Nylosan Green | C I Acid Green 25 | " |
| Lanasol Blue 3G | C I Reactive Blue 69 | " |
| Lanasol Red G | C I Reactive Red 37 | Monoazo |
| Lanasol Yellow | C I Reactive Yellow 39 | Azo |
| Fast Light Red | C I Acid Red 37 | " |
| Fast Light Yellow | C I Acid Yellow 17 | " |
| Lanasyn Brilliant Yellow | C I Acid Yellow 127 | " |
| Supralan Blue | C I Acid Blue 179 | Monoazo 1:2 metal complex |

An examination of cross-sections of the so-dyed fibers revealed that the dye had achieved more through penetration than in samples which were dyed according to present commercial processes in an aqueous dyeing medium.

EXAMPLE 2

Dyeing of Wool Fabric

An undyed wool fabric sample (2 g.) was cut (approximately 2 in. in diameter) to fit a sintered glass Buchner funnel. The funnel was heated to 150° C. and attached to a filter flask (1.1), which in turn was attached to a water aspirator.

A dyebath (100 ml.), containing Fast Light Red, was prepared as in Example 1. The wool sample was placed in the funnel and water aspiration vacuum was applied thereto. The hot (150° C.) dyeing solution was poured over the wool disc continuously for 30 seconds. The sample was washed with water and then dried.

The dyeing was repeated with the dyes outlined in Example 1.

A cross-section of fibers from each sample was obtained, using a Hardy microtome. Examination of the fibers showed that, in each sample, dyeing was even and thorough.

EXAMPLE 3

Preparation of Flame-resistant Wool

A 5% (w/v) solution of tetrabromophthalic anhydride (TBPA) in 2800 ml. of ethylene glycol was prepared and heated to 150° C. Woolen swatches (11 × 16 in., 28 g.) were immersed in the hot solution for 30 seconds. The fabric samples were removed from the solution, rinsed in water, and dried.

To prevent shrinkage of some samples during subsequent testing, these samples were made shrink-resistant by conventional treatment with a 4 to 5% perchloroethylene solution of a commercially available wool shrink-proofing resin (Dow Corning Superwash DC 109).

Flame tests were carried out according to a modified AATCC 34–1969 procedure published in AATCC Technical Manual, Vol. 48, pages 201–202 (1972). Specimens (3.5 × 10 in.), conditioned at 70° F., 65% RH, were exposed to a flame for 12 sec. Treatment is considered effective when the average char length is less than 7 inches, and the after-flame persists less than 12 sec. on the average after removal of the source.

Testing was done on unlaundered samples, on samples laundered 1, 5 and 10 times according to home-laundering techniques (these samples were made shrink-resistant as explained above), and on a sample which had been extracted continuously for 8 hours with hot methanol in a sohxlet extractor.

The results are summarized below:

| Treatment | After-flame (sec.) | Char length (in.) |
|---|---|---|
| TBPA | 0.7 | 2.3 |
| TBPA + DC 109 | 0.7 | 2.8 |
| TBPA + DC 109 (1 laundering) | 0.8 | 3.0 |
| TBPA + DC 109 (5 launderings) | 0.7 | 4.4 |
| TBPA + DC 109 (10 launderings) | 0.8 | 4.6 |
| TBPA (after 8 hours extraction with methanol) | 0.8 | 2.6 |

It is important to note that wool, made flame-resistant with TBPA according to conventional processes, retains its flame-resistant character after dry-cleaning but loses such character rapidly when subjected to normal aqueous laundering.

EXAMPLE 4

Preparation of Dyed, Flame-resistant Wool

The procedure outlined in Example 3 was followed with the exception that 0.1% (w/v) Lanasol Blue 3 G (C I Reactive Blue 69) was added to the glycol along with the TBPA.

The so-prepared product exhibited excellent coloration and flame-resistance.

EXAMPLE 5

Dyeing of Cotton Fabric

Undyed cotton fabric samples (4 × 5 in., 3 g.) were immersed in dyebaths prepared as follows: Either 1, 2 or 3 grams of Fast Red RL was dissolved in 400 ml. of ethylene glycol. The solutions were heated to and maintained at 150° C.

Samples were immersed for either 30 or 60 seconds. Following immersion, the samples were rinsed with water and dried.

An examination of the samples indicated that dyeing was even and thorough. A range of color, from pink to bright red, was obtained, depending on the severity of the treatment.

EXAMPLE 6

Dyeing of Polyester Fibers

A dyebath was prepared containing 0.1% (w/v) "Latyl" Blue (disperse dye from Dupont) in 50 ml. of ethylene glycol. The temperature of the bath was raised to and maintained at 150° C. A sample (1 g.) of polyester (Dacron) staple fibers (3 denier) was immersed in the dye solution for 30 seconds, removed therefrom, and rinsed immediately with water. The sample was dried in air.

The above experiment was repeated with a number of dyes and under varying conditions. The results are summarized below.

| Commercial Dye Name | (%) | Temp. (° C) | Time (sec.) | Result |
|---|---|---|---|---|
| Latyl Blue | 0.1 | 150 | 30 | Medium depth blue |
| | | | 60 | " |
| | | | 300 | " |
| | | 155 | 2 | " |
| | | | 5 | " |
| | | 160 | 30 | " |
| | 0.2 | 150 | 30 | Deep blue |
| | 0.4 | 150 | 30 | Deeper blue |
| | 0.8 | 150 | 30 | Very deep blue |
| Latyl Brown MS | 0.2 | 150 | 30 | Deep brown |
| Latyl Orange | 0.2 | 150 | 30 | Orange |
| Latyl Violet BN | 0.2 | 110 | 120 | Light violet |
| | | 110 | 300 | Medium violet |
| | | 140 | 60 | Deep violet |
| | | 150 | 60 | Deep violet |

After treatment in accordance with the above procedure, the samples were examined visually and microscopically. The depth of shade did not vary significantly over the range of temperatures. Further, the depth of dye penetration was through. However, depth of shade did vary considerably with dye concentration; the greater the concentration of dye in ethylene glycol, the deeper the shade of color.

The depth of shade was approximately twice that of a sample dyed under standard aqueous conditions at equivalent dye concentrations.

EXAMPLE 7

Dyeing of Acrylic Fibers

A dyebath was prepared containing 0.2% (w/v) "Sevron" Blue EG (Dupont Co. tradename) in 250 ml. of ethylene glycol. The temperature of the bath was raised to and maintained at 150° C. A one-gram sample of acrylic (Orlon) staple fibers was immersed in the dye solution for 10 seconds removed therefrom, and rinsed immediately with water. The sample was dried in air.

The above experiment was repeated for 30 seconds. Visual examination indicated that the depth of shade was not significantly different for the two samples. Microscopic examination of cross-sections of the fibers indicated complete dye penetration.

EXAMPLE 8

Dyeing of Nylon Fibers

A dyebath was prepared containing 0.2% (w/v) Alizarine Direct blue ARS (an acid milling dye) in 250 ml. of ethylene glycol. The temperature of the bath was raised to and maintained at 150° C. A one-gram sample of undyed nylon (3 denier) was immersed in the dye solution for 10 seconds and another sample for 30 seconds. The samples were removed from the bath, rinsed with water, and dried in air.

The above experiment was repeated but 0.6% (w/v) of phosphoric acid was added to the above dyebath. Visual examination indicated that the depth of shade was not significantly different for the dyed samples. Further, dye penetration was thorough.

EXAMPLE 9

Cross-dyeing of Wool and Acrylic Fibers

A dyebath was prepared by dissolving 1.5 g. of "Sevron" Red (cationic dye from Dupont Co.) and 1.5 g. of Lanasol Blue (reactive dye from Ciba-Geigy Co.) in 750 ml. of ethylene glycol. To this solution was added 3 ml. of phosphoric acid.

A one-gram sample of wool top (loose fiber) and a one-gram sample of acrylic (Orlon) staple fiber were immersed in the bath for 30 sec., withdrawn, rinsed in water, and dried in air.

The wool sample was dyed a deep blue color, whereas the Orlon sample was dyed deep red. Dye penetration was complete. Furthermore, the colors retained their intensity even after 20 aqueous launderings.

EXAMPLE 10

Cross-dyeing of Wool and Polyester Fibers

The procedure outlined in Example 9 was followed. The dyes used were 0.5% (w/v) "Latyl" yellow (disperse dye for polyesters from Dupont Co.) and 0.5% (w/v) Lanasol Blue (fiber reactive dye from Ciba-Geigy Co.)

The samples dyed were 1 g. of wool top (loose fibers) and 1 g. of polyester (Dacron) staple fiber (3 denier).

The wool sample was dyed a deep blue color; the Dacron sample, a deep yellow. Dye penetration was complete and the colors were wash-fast after 20 aqueous launderings.

EXAMPLE 11

Dyeing of Wool in Glycerol

A dyebath was prepared containing 0.7 g. of Lanasol Scarlet 2R (CI Reactive Red 78) and 3 ml. of phosphoric acid in 750 ml. of glycerol. The temperature of the bath was raised to and maintained at 160° C. A sample (2 g.) of loose wool fibers was immersed in the solution for 20 seconds, withdrawn, and rinsed in water. The sample was then dried.

The sample was dyed a deep red color and the dye was evenly distributed throughout the fiber.

EXAMPLE 12

Continuous Dyeing of Wool Yarn in Ethylene Glycol

A dyebath was prepared by dissolving 3.75 g. of Latyl Cerise (an anthraquinone dye also known as Dispersed Red Dye 59) in 750 ml. of ethylene glycol. The dyebath was heated to 155° C. Worsted wool yarn (5 g.) was passed through this hot glycol solution in a continuous manner so that the wool had a residence time of 12 seconds in the dyebath. The treated yarn was washed thoroughly in water and then dried. The yarn was dyed an attractive deep pink cerise.

EXAMPLE 13

Dyeing of Polypropylene Fiber in Ethylene Glycol

A dyebath was prepared by dissolving 0.5 g. of Food Orange 5 (an orange dye with Colour Index number 40,800) in 50 ml. of ethylene glycol. The bath was heated to 135° C. Samples of polypropylene fibers (1 g.) were immersed in this solution for 15, 30, and 60 seconds.

The so-dyed samples had a deep yellow color, which persisted after washing in running water for 60 minutes.

The above-described procedure was repeated with a number of dyes, namely, Natural Orange 4 (Colour Index number 75120), Natural Red 1 (Colour Index number 75100), and Sudan IV (red).

In all cases the fibers were dyed a deep color, which persisted after washing in running water for 60 minutes.

Having thus described our invention, we claim:

1. A process of modifying proteinaceous fibers, which comprises contacting the fibers with a solution of a dyeing or finishing agent in ethylene glycol in the absence of water and in the presence of 0.6% of an acid, based on the weight of acid to the volume of ethylene glycol, at a temperature of about from 110° to 165° C.

2. The process of claim 1 wherein the modifying agent is a dye.

3. The process of claim 1 wherein the modifying agent is a finishing agent.

4. The process of claim 1 wherein the proteinaceous fibers are wool fibers.

5. The process of claim 1 wherein the proteinaceous fibers are blended with other textile fibers.

6. The process of claim 4 wherein the wool fibers are blended with other textile fibers.

7. A process for rapidly dyeing proteinaceous fibers in the absence of water, which comprises - a. contacting the fibers with a dyebath at a temperature of about from 110° to 165° C., said dyebath containing dye, ethylene glycol as the solvent, and 0.6% of an acid, based on the weight of acid to the volume of ethylene glycol, b. continuing said contact until a desired level of dyeing is obtained, and c. separating the dyed fibers from the dyebath.

8. The process of claim 7 wherein the contact in Step *a* is attained by continuously passing the fibers through the dyebath.

9. The process of claim 7 wherein the contact in Step *b* is maintained for from about 2 seconds to 10 minutes.

10. The process of claim 7 wherein the dyebath in Step *a* further contains a finishing agent.

11. The process of claim 7 wherein the acid in Step *a* is phosphoric acid.

12. The process of claim 7 wherein the acid in Step *a* is sulphuric acid.

13. The process of claim 7 wherein the proteinaceous fibers are wool fibers.

14. The process of claim 7 wherein the proteinaceous fibers are blended with other textile fibers.

15. The process of claim 13 wherein the wool fibers are blended with other textile fibers.

16. The process of claim 8 wherein the dyebath is rejuvinated with fresh dye at appropriate times to maintain the desired level of coloration of the fibers.

17. The process of claim 8 wherein the dyebath further contains a finishing agent.

* * * * *